United States Patent [19]

Deussner et al.

[11] 4,088,438

[45] May 9, 1978

[54] APPARATUS FOR THE HEAT TREATMENT OF FINE-GRAINED MATERIAL

[75] Inventors: Herbert Deussner; Hubert Ramesohl, both of Bensberg-Refrath; Horst Herchenbach, Troisdorf, all of Germany

[73] Assignee: Klockner-Humboldt-Deutz Aktiengesellschaft, Germany

[21] Appl. No.: 724,593

[22] Filed: Sep. 17, 1976

[30] Foreign Application Priority Data

Sep. 18, 1975 Germany ..... 2541564

[51] Int. Cl.[2] ..... F27B 7/02; F27B 15/00

[52] U.S. Cl. ..... 432/106; 34/57 R; 432/4; 432/58

[58] Field of Search ..... 432/14, 15, 58, 106; 34/57 R; 106/100

[56] References Cited

U.S. PATENT DOCUMENTS

| | | | |
|---|---|---|---|
| 3,452,968 | 7/1969 | Shimizu et al. | 432/58 |
| 3,891,382 | 6/1975 | Lawall et al. | 432/58 |
| 3,904,353 | 9/1975 | Bosshard et al. | 432/14 |
| 3,910,754 | 10/1975 | Weber et al. | 432/14 |
| 3,980,486 | 9/1976 | Touborg | 106/100 |
| 4,014,641 | 3/1977 | Shigeyoshi et al. | 432/58 |

*Primary Examiner*—John J. Camby

*Attorney, Agent, or Firm*—Hill, Gross, Simpson, Van Santen, Steadman, Chiara & Simpson

[57] ABSTRACT

An apparatus for the heat treatment of fine-grained material, particularly pulverized raw material for use in the manufacture of cement, the apparatus comprising a preheater composed of a plurality of superimposed cyclones, the preheater feeding a rotary kiln. An exhaust conduit is connected to the rotary kiln and has a combustion zone formed therein. The gas discharge from one of the intermediate cyclones is directed into the combustion zone. The exhaust conduit includes a pair of upper and lower concentric conduits, the upper conduit having its lower end received in spaced relation to the upper end of the lower conduit and terminating at the combustion zone. A fuel feed conduit is disposed between the lower end of the upper conduit and the upper end of the lower conduit. The arrangement provides for a more efficient treatment of finely divided particles with the hot gases.

15 Claims, 1 Drawing Figure

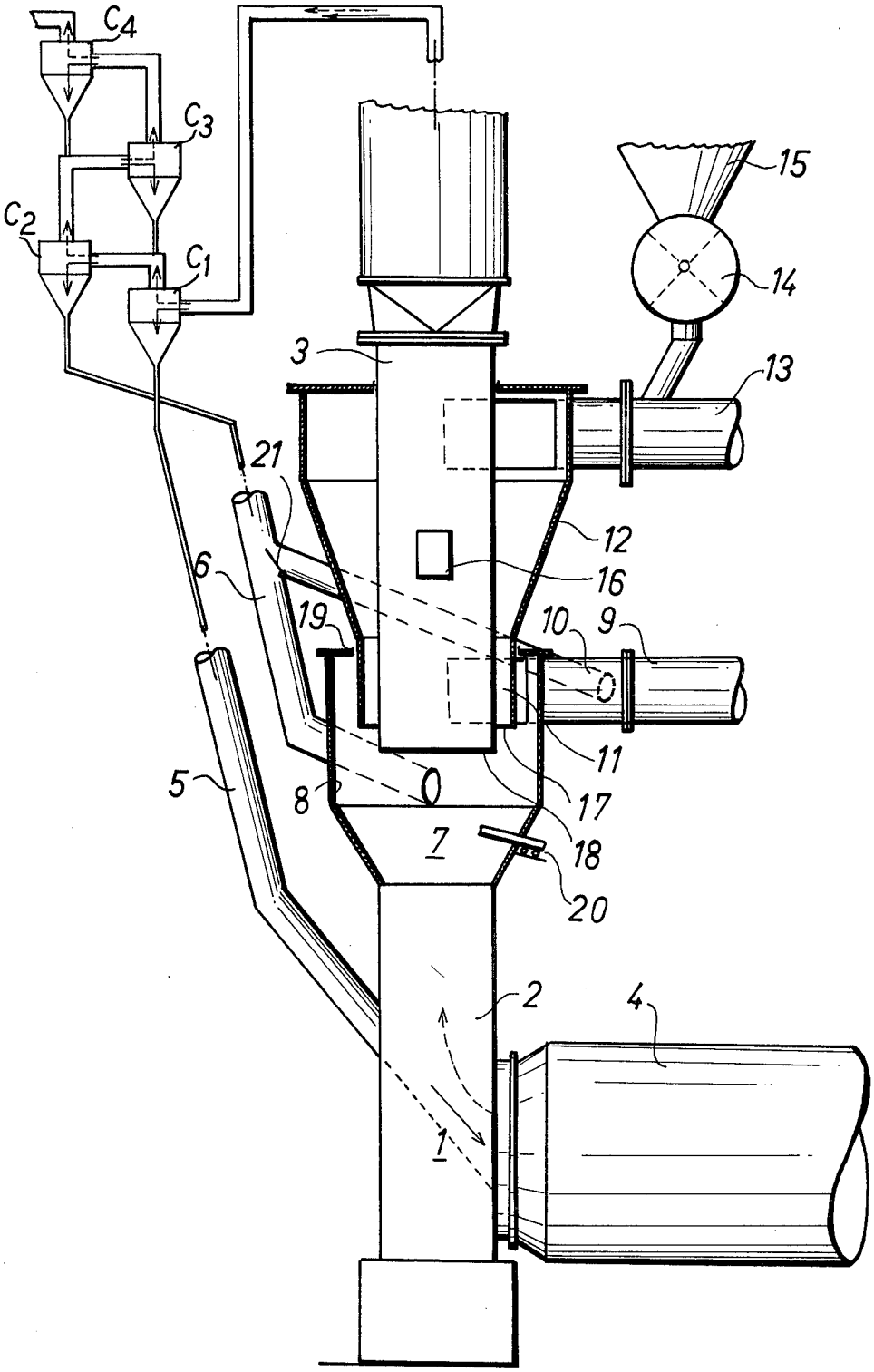
C4
C3
C2
C1
15
14
13
3
21
12
16
6
19
10
9
11
5
8
17
7
18
20
2
4
1

APPARATUS FOR THE HEAT TREATMENT OF FINE-GRAINED MATERIAL

BACKGROUND OF THE INVENTION

1. Field of the Invention

This invention is in the field of heat treating fine-grained material, such as pulverized raw material used in the manufacture of cement, utilizing a concentric series of exhaust pipes and providing a combustion chamber in which the finely divided particles are suspended and uniformly heat treated.

DESCRIPTION OF THE PRIOR ART

In the production of cement, argillaceous earth, lime, dolomite or the like, is heat treated by first being charged or suspended in a gas heat exchanger consisting of several cyclones connected in series. The particles of raw material are preheated in countercurrent contact with hot exhaust gases arising from a rotary kiln. Subsequently, they are introduced into the rotary kiln and burnt to completion. The heating process in the rotary kiln itself consists of two sequences, namely, a low temperature process which normally involves complete calcining of the material and a high temperature process for sintering the material. With this conventional method, wherein the preheating of the charged fine-grained material takes place in a separate preheater, only a small part of the total energy is transferred to the material in the preheater and the greatest part of the heating load must be accomplished in the rotary kiln.

In this conventional method, almost the entire amount of thermal energy is supplied to the rotary kiln at high output yields. Because of the non-uniform heating requirements in the rotary kiln, the thermal effectiveness and the yield capacity of the furnace is limited. The life of the firebrick in the combustion zone is appreciably decreased so that the investment costs and the cost of maintenance for the rotary kiln are proportionately very high. In order to be able to use a smaller cross-section or shorter furnace length in the rotary kiln, it has been suggested that a low temperature combustion zone be arranged between the preheater and the rotary kiln.

Thus, there is described a heat treatment apparatus in German Laid Open Spectification No. 2,361,427 wherein a precombustion zone is constructed in the nature of a shaft or pit furnace and contains a mixing zone arranged laterally on the shaft for receiving separate supplies of fuel and pulverized raw material used in the manufacture of cement. The mixture of fuel and pulverized raw material is then brought into contact with an oxygen-containing stream of gas from the rotary kiln flowing outwardly in the shaft, thereby proceeding to calcine the raw pulverized material. With such an arrangement, particularly in the case of using solid fuels, no uniform mixing can be expected.

In German Laid Open Specification No. 2,324,519, there is a disclosure of combining the lowermost cyclone of the preheater in a combustion zone between the preheater and the rotary kiln, together with fuel feed in such a manner that the orifice of the fuel feed is covered by the stream of material. With this arrangement, particularly in the case of using solid fuels, a non-uniform distribution of materials is accomplished. With this arrangement at certain points in the combustion zone, the concentration of raw material is so high that poor combustion conditions prevail. At other points, the concentration of raw material is relatively low, resulting in high temperature peaks at these points and over-burning of the material.

SUMMARY OF THE INVENTION

The apparatus of the present invention overcomes the disadvantages of previously known systems and provides a separate combustion zone arranged between the preheater and the rotary kiln. In this combustion zone, the fuel and the raw material are so intimately mixed with one another that the individual fuel particles are deposited directly on the individual particles of raw material so that upon the subsequent combustion of the fuels, a uniform transfer of heat to the raw material is accomplished.

In accordance with the present invention, the exhaust gas conduit on the rotary kiln is formed in at least two parts, the upper part being immersed in the lower part and spaced therefrom. The inner pipe is surrounded by at least one fuel feed conduit. The fuel feed and the material discharge conduit from an intermediate cyclone are discharged into the lower pipe. With this type of construction, a simple and economical arrangement is provided for supplying fuel and fine grained material into the exhaust gas conduit of the rotary kiln. The particles of fuel may be distributed uniformly over the cross-section of the lower pipe and upon contact with the upwardly flowing exhaust gases of the rotary kiln are finely dispersed so that they accumulate on the particles of pulverized raw material which are at a temperature of about 650° to 700° C. When combustion sets in, the fuel particles then give off their heat content uniformly to the individual particles of pulverized raw material used in the manufacture of cement. Accordingly, a uniform calcination is achieved in the charged raw material.

In the preferred form of the present invention, the lower pipe is provided with a widened part in cross-section which serves as a combustion chamber, and which receives the lower end of the upper pipe. It is preferable that the combustion chamber is constructed at least partially with a cylindrical surface and that a heating gas conduit discharges tangentially into the cylindrical part. Thus the fuel particles introduced through the fuel feed into the combustion chamber with the aid of the heating gases introduced tangentially into the combustion chamber are whirled together with the particles of pulverized raw material and an overall uniform intermixture takes place between the fuel and the raw material. This accomplishes a better heat transfer and therefore a better calcination of the raw material is burnt to completion of the rotary kiln.

BRIEF DESCRIPTION OF THE DRAWINGS

The single FIGURE in the drawings represents rather schematically an apparatus which can be used for the purpose of the present invention, the apparatus being shown partly in cross-section and partly in elevation.

DESCRIPTION OF THE PREFERRED EMBODIMENTS

In a particularly preferred embodiment of the present invention, the fuel feed is connected with a central centrifugal chamber arranged about the upper pipe into which fuel is fed tangentially through an injection conduit. The fuel feed conduit preferably encloses the upper pipe and is coaxial therewith. By this means, the particles of fuel issue from the centrifugal chamber with high speed and rotate helically over the annularly shaped opening of the fuel feed conduit into the combustion chamber where they are picked up by eddy currents of heating gas introduced through a heating gas conduit tangentially into the combustion chamber and are distributed over the entire free cross-section of the combustion chamber uniformly. A uniform combustion of the fuel results, and an optimal heat transfer to the finely divided preheated particles of pulverized raw material is achieved. In the case of solid fuel, the injection conduit may be connected to an injection mill, for example, an impact pulverizer which is supplied with coarsely lumped coal. This coal is crushed and delivered in a stream to the centrifugal chamber. In the upper pipe in the area of the centrifugal chamber there is provided an adjustable gas withdrawal valve through which the injected gases may be withdrawn before they reach the fuel particles in the combustion chamber. This means, that a very high temperature level may be maintained in the combustion chamber.

The fuel feed conduit enters the combustion chamber spaced from the wall of the combustion chamber. By this means, the particles of fuel circulating in the annular opening of the fuel feed conduit are heated over a longer path indirectly by the stream of heating gas whirling about the fuel feed conduit in the combustion chamber before they enter into direct contact with the hot gases. A still more uniform and desirable heating of the particles of fuel is attained so that the latter upon direct contact with the furnace exhaust gases heated to 1,100° to 1,200° C simultaneously begin to oxidize. The depth of immersion of the upper pipe and/or fuel feed conduit in the combustion chamber is preferably made adjustable. Consequently, the preheating of the particles of fuel charge can be adjusted exactly. Also, through the adjustment of the depth of immersion, the location of the area of the combustion chamber in which the particles of fuel encounter the particles of pulverized raw material can be predetermined. In a further development of the invention, there is provided at least one auxiliary burner in the combustion chamber below the opening of the upper pipe. Consequently, the position of the combustion zone within the combustion chamber particularly in starting up may be stabilized.

A further description of the present invention will be made in conjunction with the attached drawing.

An apparatus according to the present invention for heat treating fine grained material may consist of an exhaust gas conduit 1 connected to a rotary kiln 4 and formed of two interfitting pipes 2 and 3. The conduit 1 is disposed between the rotary kiln 4 and a preheater consisting of several superimposed cyclones labeled $C_1$, $C_2$, $C_3$ and $C_4$. A pulverized raw material conduit 5 extending from the lowermost cyclone $C_1$ is directed into the rotary kiln 4. A pulverized raw material conduit 6 leading from the next higher cyclone $C_2$ is directed into the exhaust gas conduit. The lower pipe section 2 provides a combustion chamber 7 formed from an enlarged cross-section of the lower pipe. The upper pipe 3 extends coaxially into the combustion chamber 7 and is spaced from the wall 8 of the combustion chamber. The combustion chamber 7 has in its upper part a cylindrical section into which a heating gas conduit 9 opens tangentially.

In the heating gas conduit 9 which is preferably combined with a cooler, there is provided a supply conduit 10 for a partial stream of material received from an intermediate cyclone such as $C_2$.

The upper pipe 3 is surrounded coaxially in spaced relation with a fuel feed 11 which is provided with a turbulence chamber 12 arranged centrally about the upper part of the pipe. An injection conduit 13 for fuel materials discharges into the turbulence chamber 12.

In the embodiment shown by way of example, a storage container 15 for solid fuels is provided with a dispensing valve 14 to feed the injection conduit 13.

The injection conduit 13 may be attached to a direct feeding mill, not shown, to pick up fine dust particles and carry them along in the injection conduit. In the upper part of the turbulence chamber 13 there is provided an adjustable gas discharge valve 16 which produces a direct connection between the inner part of the turbulence chamber 12 and the upper pipe 3.

The discharge opening 17 of the fuel feed conduit 11 terminates in the combustion chamber 7 and extends a short distance above the discharge orifice 18 in the upper pipe 3. The combustion chamber is sealed by means of a cover 19 against the atmosphere. In the lower part of the combustion chamber 7 which is preferably constructed as a truncated cone, there is arranged an auxiliary burner 20.

In operation, for the heat treatment of finely grained material, solid fuel particles are withdrawn from the storage chamber 15 and injected int the turbulence chamber 12 with a velocity which preferably lies between 40 m/sec. and 80 m/sec. Because of the air current circulating in the turbulence chamber with high speed, the particles of fuel are carried to the inner wall of the turbulence chamber 12 and there slide spirally downwardly into the fuel conduit 11. Here they proceed into the space about the upper pipe 3 into the combustion chamber 7. From the annularly shaped orifice 17 of the fuel feed conduit 11 the fuel particles pass uniformly distributed into the combustion chamber 7 and are there acted upon by an eddy of hot gases which are conveyed through the hot gas conduit 9 from the combustion chamber, not shown in detail. In the combustion chamber there results an optimal intermixture of oxygen gases and fuel particles so that the fuel particles are preheated to ignition temperature and are present within the combustion chamber in finely dispersed form.

The combustion chamber 7 through the conduit 6 receives pulverized raw material from the intermediate cyclone $C_2$. The pulverized raw material is preheated to about 650° to 700° C and is finely distributed through the hot exhaust gases rising from the rotary kiln 4 in the combustion chamber 7 where it encounters finely dispersed solid fuel particles at the same temperature level, so that an intimate mixture of fuel and particles of pulverized raw material is present. Consequently, the solid fuel particles when they come in contact with the hot furnace gases at about 1100° to 1200° C are burned and are able to give off their heat energy uniformly to the particles of raw pulverized material. Because of the combustion expanding in the combustion chamber 7 so much heat is supplied to the particles of raw material that a uniform calcination takes place. The individual particles of material are carried aloft by the hot stream of exhaust gas from the rotary kiln 4 through the upper pipe 3 and conveyed to the lowermost cyclone $C_1$ of the preheater, separated and conveyed through the conduit 5 for pulverized raw material as uniformly calcined material to the high temperature sintering in the rotary kiln.

To maintain optimal temperature conditions in the combustion chamber, a part of the pulverized raw material from the cyclone $C_2$ is introduced through conduit 6 and regulating valve 21 into the combustion chamber. The excessively high temperature of the stream of heating gas is then lowered to the desired temperature for admixture with the particles, the temperature corresponding to the temperature of the particles of raw material introduced into the combustion chamber.

For the stabilization of the combustion zone in the combustion chamber 7, in the lower area of the combustion chamber, there is provided an ignition or auxiliary burner 20. In the starting phase of the operation, this auxiliary burner may support the combustion particles of fuel in the chamber particularly when no thermal equilibrium condition has been reached.

The apparatus according to the present invention is not limited to the embodiments shown by way of example, but they include several types of treatment apparatus arranged in superimposed relation so that the calcination of the pulverized raw material takes place over a longer period of time. In addition, the operation of the apparatus is not limited solely to the use of solid fuels but liquid and gaseous fuels may likewise be used.

We claim as our invention:

1. An apparatus for the heat treatment of fine-grained material comprising a preheater composed of a plurality of superimposed cyclones, a rotary kiln in series with said preheater, an exhaust conduit connected to said rotary kiln and having a combustion zone therein, means connecting the gas discharge from one of the intermediate cyclones into said combustion zone, said exhaust conduit including upper and lower concentric conduits, the upper conduit being of smaller diameter than said lower conduit and having its lower end received in spaced relation to the upper end of the lower conduit and terminating at said combustion zone, a fuel feed conduit disposed between said lower end of said upper conduit and said upper end of said lower conduit and being spaced from both, and means for delivering fuel into said fuel feed conduit.

2. An apparatus according to claim 1 in which the upper end of said lower conduit has an enlarged end portion in which said upper conduit is received and which provides said combustion chamber.

3. An apparatus according to claim 1 in which said combustion chamber is generally cylindrical and is provided with a tangential gas discharge.

4. An apparatus according to claim 3 which includes means connecting said tangential gas discharge with one of the intermediate cyclones.

5. An apparatus according to claim 1 in which said fuel feed conduit has a tangentially disposed inlet for receiving fuel therein.

6. An apparatus according to claim 1 in which said fuel feed conduit discharges slightly above the lower end of said upper conduit.

7. An apparatus according to claim 1 which includes an auxiliary burner in said combustion chamber.

8. An apparatus according to claim 1 including a material feed conduit leading from an intermediate cyclone to the fuel feed conduit.

9. An apparatus according to claim 1 including a centrifugal chamber arranged concentrically around the upper conduit with its low end discharging into the lower conduit and having a fuel injection conduit leading tangentially therein.

10. An apparatus according to claim 9 including means for feeding solid fuel into said fuel injection conduit.

11. An apparatus according to claim 9 wherein said centrifugal chamber is coaxial with said upper conduit.

12. An apparatus according to claim 9 wherein the fuel feed conduit is spaced radially outwardly from the lower end of the centrifugal chamber.

13. An apparatus according to claim 1 wherein the fuel feed conduit tangentially enters the lower conduit above the lower end of the upper conduit.

14. An apparatus according to claim 9 including a withdrawal valve in the upper conduit within the centrifugal chamber.

15. An apparatus according to claim 1 including an auxiliary burner within said lower conduit.

* * * * *